United States Patent [19]

Draaisma et al.

[11] Patent Number: 4,627,802

[45] Date of Patent: Dec. 9, 1986

[54] ROTARY VANE COMPRESSOR WITH INLET AND OUTLET VALVES IN THE ROTOR

[76] Inventors: Rudolph Draaisma; Werner Reichmann, both of Öresundsgatan 30, S-252 28 Helsingborg, Sweden

[21] Appl. No.: 681,850

[22] PCT Filed: Apr. 12, 1984

[86] PCT No.: PCT/SE84/00133

§ 371 Date: Dec. 11, 1984

§ 102(e) Date: Dec. 11, 1984

[87] PCT Pub. No.: WO84/04137

PCT Pub. Date: Oct. 25, 1984

[30] Foreign Application Priority Data

Apr. 12, 1983 [SE] Sweden ..... 8302006

[51] Int. Cl.[4] ..... F04C 18/00; F04C 23/00; F04C 29/08; F16K 31/12

[52] U.S. Cl. ..... 418/185; 418/186; 418/13; 251/57

[58] Field of Search ..... 418/13, 185–187, 418/269; 137/513; 251/57

[56] References Cited

U.S. PATENT DOCUMENTS

| | | | |
|---|---|---|---|
| 819,674 | 5/1906 | Rochow | 418/13 |
| 1,729,951 | 10/1929 | Lower | 418/269 |
| 2,353,965 | 7/1944 | Meador | 418/255 |
| 3,406,634 | 10/1968 | Ounsted | 418/187 |
| 3,994,641 | 11/1976 | Southard | 418/269 |

FOREIGN PATENT DOCUMENTS

| | | | |
|---|---|---|---|
| 1261674 | 4/1961 | France | 418/185 |

*Primary Examiner*—John J. Vrablik
*Attorney, Agent, or Firm*—Ladas & Parry

[57] ABSTRACT

A vane compressor comprising a rotor eccentrically arranged in a cylindrical housing and vanes, which define a space between the periphery of the rotor and the inner surface of the housing. The volume of the space varies during the rotation of the rotor due to the eccentricity of the rotor. The rotor (14) comprises inlet valves (19, 23) arranged between the inlet (12) of the compressor and the space (46) in order to open when the pressure in the space (46) is below the pressure at the inlet (12) in order to suck in air inside the space (46) during the intake stroke of the rotor. Moreover, the rotor comprises outlet valves (20, 24) arranged between the space and the outlet (48) of the compressor and adapted to open when the pressure in the space (46) exceeds the counter-pressure at the outlet (48) during the compression stroke. The inlet valves and the outlet valves are interconnected by a hydraulic system in such a way that the inlet valve (19, 23) at one side of the rotor is opened at the same time as the outlet valve (20, 24) is opened at the diametrically opposite side of the rotor.

5 Claims, 4 Drawing Figures

ROTARY VANE COMPRESSOR WITH INLET AND OUTLET VALVES IN THE ROTOR

FIELD OF THE INVENTION

The present invention relates to a vane compressor of the type comprising a rotor eccentrically arranged in a cylindric housing and vanes, which defines a space between the periphery of the rotor and the inner surface of the housing, the volume of said space varying during the rotation of the rotor.

PRIOR ART

A compressor of this type is disclosed in e.g. the French Patent specifications Nos. FR-A-826424 and FR-A-1,261,674.

Such a vane compressor has been used in many applications and operates well in most occasions. However, it cannot usually operate with different counter-pressures. If the counter-pressure exceeds the counter-pressure for which the compressor is designed, the compressor cannot operate. On the other hand if the compressor is designed for high counter-pressure and is connected to a low counter-pressure it will have a very low efficiency and will thus require quite a big power from the power source. Moreover, in the last-mentioned case, the compressor will vibrate excessively.

The object of the present invention is to provide a compressor of the type indicated above, which can efficiently operate at different counter-pressures.

SUMMARY OF THE INVENTION

According to the invention the rotor comprises at least one inlet valve adapted in the rotor between the inlet of the compressor and said space and adapted to open when the pressure in the space is below the pressure in the inlet in order to suck in air inside the space during the intake stroke of the rotor and at least one outlet valve adapted in the rotor between said space and the outlet of the compressor and adapted to open when the pressure in the space exceeds the counter-pressure at the outlet during the compression stroke. The inlet valve and the outlet valve are interconnected in such a way that the inlet valve at one side of the rotor is opened at the same time as the outlet valve at the diametrically opposite side of the rotor. Preferably the valves are interconnected by means of a hydraulic or pneumatic system.

By arranging the valves in the rotor body it is achieved that the construction is not dependent on a specific placement of an outlet valve in the housing but the opening of the valves can take place at any angular position of the rotor. In spite of the arrangement in the rotor, the valves are pressure controlled. This is made possible by the interconnection of pairs of inlet valves and outlet valves by a preferably hydraulic system, which interconnects the valves and thus balance the centrifugal forces exerted on the valves.

In a further aspect of the invention, the rotor is divided in several sectors which are clamped between cylindrical plates so that a cross-shaped space is defined between the sectors, which space receives the vanes. The compressor may comprise several compressor units interconnected in series to obtain a required output pressure.

SHORT DESCRIPTION OF THE DRAWINGS

DESCRIPTION OF THE PREFERRED EMBODIMENT

Figure 1:
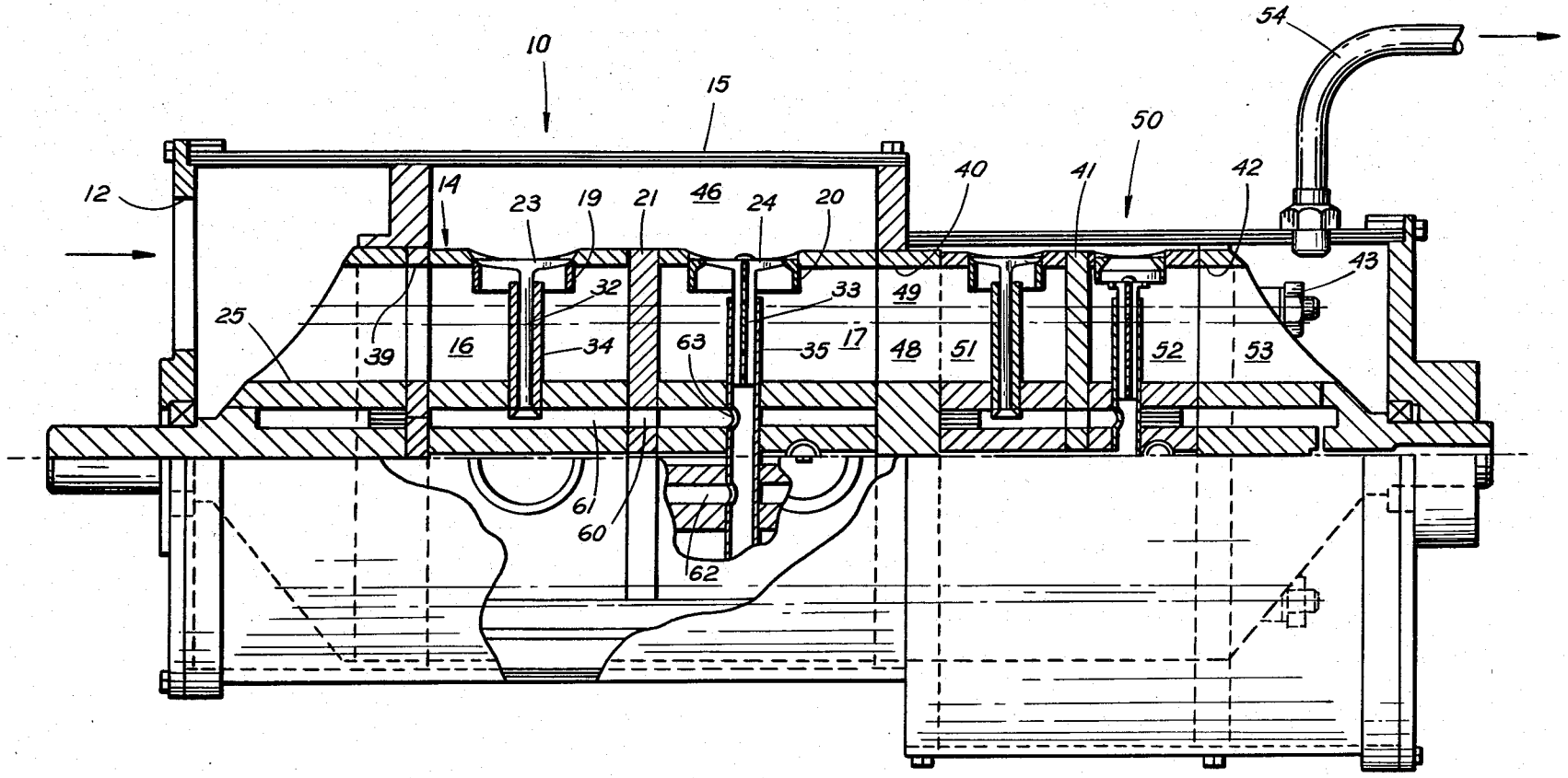
FIG. 1 is a partially broken side view of the compressor according to a preferred embodiment of the invention.
Figure 2:
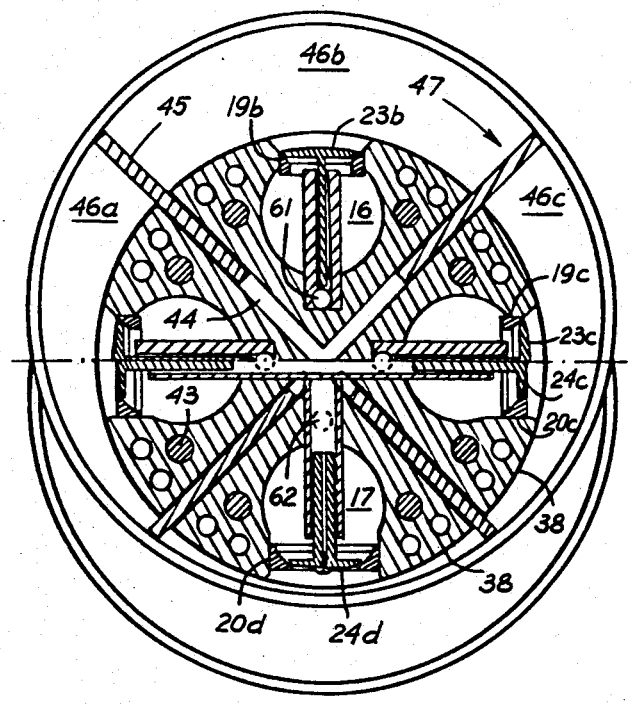
FIG. 2 is a cross-sectional view taken along the line II—II in FIG. 1.

The compressor according to the preferred embodiment of the invention is shown in FIGS. 1 and 2. The compressor unit 10 comprises an air inlet 12, which opens to the inner space of an essentially cylindrically shaped rotor 14. The rotor 14 is eccentrically journalled in a cylindrical housing 15, compare also FIG. 2.

The rotor 14 consists of a cylindrical body having eight axial apertures 16 and 17, in which four apertures 16 open to the left (seen according to FIG. 1) in the body and four apertures 17 open to the right in the body, whereby each pair of apertures 16 and 17 are separated in the axial direction by a plate 21. Each aperture 16 and 17 is radially connected to the periphery of the rotor body 14 through valve seats 19 and 20 as is shown in FIG. 1. A valve body 23 co-operates with each valve seat 19 at the left side of the rotor 14. The valve body 23 is connected to a shaft 32, e.g. by means of a screw. The shaft is slidably received in a sleeve 34, which is inserted and suitably welded in a hole in the central portion 25 of the rotor body 14. The radially outward end of the sleeve 34 extends almost up to the valve body 23, when it is placed in the position contacting the valve seat. Thus, the valve body 23 is only movable outwards in order to open the valve seat 19, when the pressure in the space outside the valve body 23 is lower than the pressure below the valve body, as will be described more in details below. A stop means (not shown) prevents the valve body from moving too far outwards.

The valve seat 20 at the right side of the rotor co-operates in a similar way with a valve body. 24, which is attached to a shaft 33, which runs in a sleeve 35. The sleeve 35 is shorter than the sleeve 34 and permits the valve body 24 to move inwards when the pressure in the aperture 17 is lower than the pressure outside the valve body.

The rotor body 14 consists in cross-section of four separate sectors 38 having an apex angle of 90°. These sectors are clamped between several short cylindrical plates 39, 21, 40, 41, 42 by means of several bolts 43, e.g. two for each sector. The sectors are clamped in such a way that a radial groove 44 is defined between each sector. These grooves 44 have the same width from the periphery to the centrum and receive radially movable vanes 45, which extend outside the periphery of the rotor body 14 in order to sealingly co-operate with the inner surface of the rotor housing 15 and to define a space 46. The vanes are biased outwards as will be described more closely below. By this construction there is created crossing grooves in which the vanes are placed. By this construction the diameter of the rotor can be decreased since the central portion 25 of the rotor now can be used, compared to a homogeneous rotor having machined grooves.

The plates 39, 40 and 42 are provided with apertures, which communicate with said apertures 16, 17 in order to allow free air flow. However, the plates 21, 41 are essentially non-perforated in order to separate the apertures 16, 17, The compressor operates as stated below. The air enters from the left through the inlet 12 in the plate 39 and reaches the four apertures 16 in the left side of the rotor 14, which is the suction side. In FIG. 2 the left space defined by the vanes 45 between the rotor 14 and the housing 15 has been designated with 46*a*. When the rotor moves in the direction of the arrow 47, the space 46*a* will increase in volume, whereby the pressure decreases. In this position, the valve 24*a* is normally closed, while the valve 23*a* will open during the rotating movement when the pressure in the space 46*a* is lower than the inlet pressure of the aperture 16. During this movement air is sucked inside the space 46*a* until it reaches the upper position designated with 46*b*. At this position, the valve 23*b* will close and the continued rotation entails that the air is compressed. When the air pressure in the space 46*c* exceeds the counter-pressure at the outlet 48 of the first stage of the compressor, the valve 24*c* opens and the air in the space 46*c* is forced out through the outlet 48 to the inlet 49 of a second compressor stage 50.

The second compressor stage, which is constructed in the same principal way as described above, further increases the pressure. The second compressor stage 50 is constructed correspondingly narrower, since the air volume passing the second stage is less than the air volume passing the first step due to the increase pressure. It comprises apertures 51, 52 and valve bodies and valve seats as shown.

Finally, the compressed air is exhausted from the outlet 53 through a pipe 54 and connected to the consumer of compressed air in a conventional manner.

As shown in FIG. 1 the valve bodies 23, 24 are interconnected by a hydraulic system 60 comprising two channels 61 and 62 for each pair of mutually diametrically positioned pairs of valve bodies. The sleeve 35 of the outlet valve extends to the centre of the rotor body 14 and is sealingly connected to the diametrically opposite sleeve 35. Each sleeve 35 is connected to the corresponding channel 61, 62 by means of a hole 63. Each sleeve 34 of the inlet valves is connected to the corresponding channel 61, 62 without restricting it. To the left of FIG. 1 one of the channels is connected to a relief system 70 which will be described in more details below. As shown in FIG. 1, the outlet valves being arranged by 90° relative to the above-mentioned pair of outlet valves are offset a certain distance to the right in order to define its own system of channels 61*a*, 62*a* (not shown).

The channels 61, 62 and the sleeves 34, 35 below the shafts 32, 33 are filled by a non-compressible hydraulic fluid. Thus, each sleeve 34, 35 and corresponding shaft 32, 33 act as a hydralic cylinder unit. Since the four interconnected valve bodies are arranged on diametrically opposite sides of the rotor it is appreciated that the centrifugal forces acting upon the free valve bodies counteract each other and thus each valve body is unaffected by the centrifugal forces and may operate in dependence of the pressure differences at oppsite sides of the valve. It is also appreciated that each pair of inlet valves and outlet valves influence on each other. However, opening of one inlet valve takes place at almost the same angular position as the opening of the diametrically opposite outlet valve. Thus, these valves will help each other in a servo system.

If there is encountered difficulties due to different angular position for the opening of the inlet valve and its co-operating diametrically opposite outlet valve it is contemplated that the outlet valve may be placed slightly offset from this diametrical relationship for certain applications. Such an offset is not considered necessary for most applications.

As shown in FIG. 2 the rotor is made up of four sectors 38 of 90° which leaves a narrow radial groove between each pair of sectors. These grooves comprise the vanes 45. The cross-shaped space inside the vanes 45 in the grooves is connected to a fluid source under pressure which forces the vanes outwardly towards the interior surface of the housing. This fluid source may be a hydraulic fluid source or preferably a pneumatic fluid source. In a preferred embodiment this pneumatic fluid source is taken directly from the outlet of the compressor.

This pressurized fluid source may be replaced by springs acting between each pair of vanes. Thus, the springs may be positioned interdigiting having an angle of 90° between each spring in the longitudinal direction. Since the distance between the diametrically opposite vanes does not vary considerably, the springs will not be subjected to any great compression. Thus, the spring force excerted on the vanes is substantially constant.

The vanes may at their outer end co-operate with a ring-shaped element which slides along the interior surface of the housing as is wellknown per se, cf. e.g. British Patent Specification UK-A-348,524.

When the valves are operating in the hydraulic system there is developed a negative pressure in the hydraulic system 60 due to the centrifugal forces acting upon the valve bodies. This negative pressure depends on the rotational speed of the rotor as well as the different air pressures prevailing. This pressure oscillates at the opening and closing of the valves.

Figure 3A:
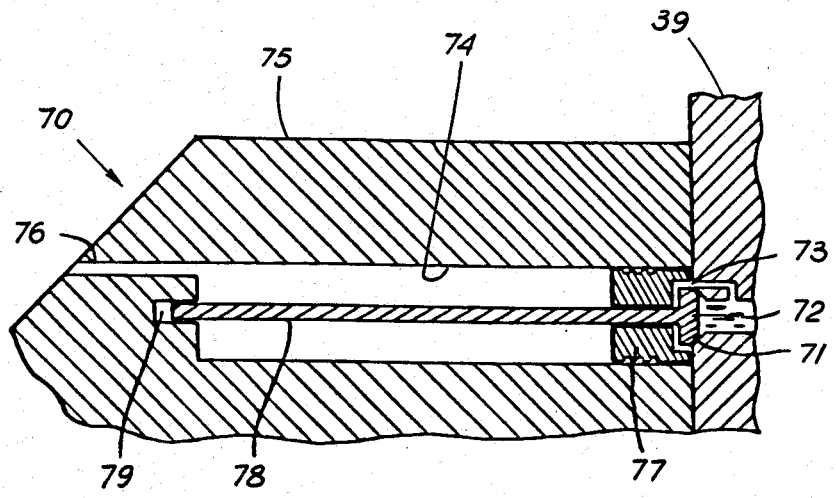
FIGS. 3*a* and 3*b* are longitudinal sectional views of a relief system for the compressor according to FIGS. 1 and 2.
Figure 3B:
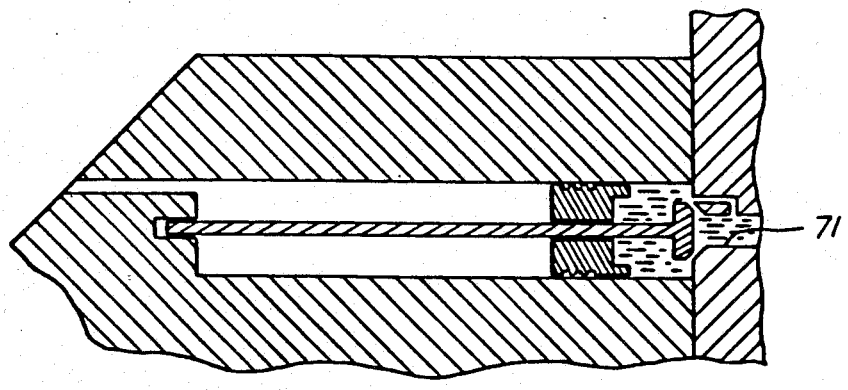

Moreover, the hydraulic fluid is subjected to a certain heat expansion due to the heat developed during the compression stroke. Thus, a relief system is provided to take care of the surplus hydraulic fluid developed during the heat expansion. The relief system is shown in all details in FIG. 3.

The channel 61 is connected to the relief system 70 through an opening 71 in the plate 39. The opening is normally closed by a piston 72 but leaves a small hole 73 free. The piston is movable in a cylinder 74 formed in the plate 39 and end portion 75 of the rotor. The cylinder 74 is connected to the atmosphere through a small hole 76. The cylinder comprises a second piston 77 which is free to move along a shaft 78. The shaft extends longitudinally over the length of the cylinder 74 and is at one end connected to the first piston 72 and extends at its other end inside a centrally positioned hole 79 in the end wall of the cylinder. The shaft 78 and the hole 79 define an air-spring which biases the piston 72 to the right in FIG. 3.

Thus, the second piston 77 divides the cylinder 74 in a left portion communicating with the atmosphere and a right portion communicating with the hydraulic system 60 through the opening 71 and the hole 73.

The relief system operates as described below. If the pressure in the hydraulic system exceeds the atmospheric pressure, the first piston 72 is opened and hydraulic fluid is forced inside the cylinder 74, whereby the second piston 77 moves to the left. As soon as the pressure in the hydraulic system decreases below the atmospheric pressure, the first piston is closed and entraps a volume of hydraulic fluid inside the cylinder 74. However, the atmospheric pressure acting upon the left side of the second piston 77 forces a certain amount of hydraulic fluid through the hole 73 back to the hydraulic system. By a suitable dimensioning of the areas of the opening 71 and the hole 73 the relief system will take care of eventual excess hydraulic fluid in order to ensure safe operation of the device.

If the compressor operates at vastly changing conditions including different rotational speeds it might be necessary to control the pressure in the left side of the cylinder 74 in dependence of the rotational speed. This control may be achieved by a radial sleeve, which comprises a piston having a certain weight. The centrifugal forces act upon said piston and forces it outwards in order to decrease the pressure inside the left portion of the cylinder at higher rotational speeds.

A person skilled in the art realizes that different approaches may be used to solve this problem.

Industrial appliability

The compressor according to the invention adapts the vane-type compressor for use at applications having varying counter-pressure. The application areas are too wide to be mentioned here, but a skilled person will find use of this compressor in almost every case where compressed air is required.

A preferred embodiment of the invention has been described above in order to examplify the invention. However, this embodiment may be modified in many respects without departing from the spirit and scope of this invention. Such modifications obvious to a skilled person are intended to be within the scope of the invention. The invention is only limited by the appended claims.

We claim:

1. A vane compressor comprising a rotor eccentrically arranged in a cylindric housing and vanes located in the rotor and defining spaces between the periphery of the rotor and the inner surface of the housing, the volume of each of said space varyng during the rotation of the rotor, said rotor comprising at least two inlet valves, each located in the rotor between an inlet of the compressor and one of said spaces, and at least two outlet valves each located in the rotor between one of said spaces and an outlet of the compressor and adapted to open when the pressure in said space exceeds the counterpressure at the outlet during the compression stroke, said inlet valves being adapted to open when the pressure in said space is below the pressure of the inlet in order to suck in air inside said space during the intake stroke of the rotor; and said inlet valves and outlet valves being physically interconnected in such a way that the inlet valve at one side of the rotor is opened substantially at the same time as the outlet valve at the diametrically opposite side of the rotor.

2. A vane compressor as claimed in claim 1, wherein the valves are interconnected by a hydraulic system filled with a hydraulic fluid.

3. A vane compressor as claimed in claim 1, wherein the vanes are interconnected by a pneumatic system.

4. A vane compressor as claimed in claim 2 further comprising a relief system for taking up excess hydraulic fluid from said hydraulic system at the heat expansion thereof.

5. A vane compressor as claimed in claim 4, wherein the relief system comprises a cylinder which is connected to the hydraulic system by an opening and a small hole, the opening normally being closed by a piston, whereby hydraulic fluid is forced inside the cylinder when the pressure in the hydraulic system exceeds a predetermined pressure and that the hydraulic fluid is returned from the cylinder to the hydraulic system at a low rate, when the pressure in the hydraulic system is below said predetermined pressure.

* * * * *